United States Patent [19]

Hayashi et al.

[11] 3,995,454

[45] Dec. 7, 1976

[54] NEEDLE WRAPPING DEVICE

[75] Inventors: Teishichi Hayashi, Kosakai; Yoshiyasu Sakata; Akira Mukai, both of Hamamatsu, all of Japan

[73] Assignee: Sakurai Limited, Shizuoko, Japan

[22] Filed: May 23, 1975

[21] Appl. No.: 580,409

[30] Foreign Application Priority Data

June 10, 1974 Japan ..... 49-67257[U]

[52] U.S. Cl. ..... 66/135

[51] Int. Cl.[2] ..... D04B 9/32

[58] Field of Search ..... 66/135, 81, 192, 86 E, 66/193, 85 A

[56] References Cited

UNITED STATES PATENTS

| | | | |
|---|---|---|---|
| 2,104,232 | 1/1938 | Lawson | 66/135 |
| 2,204,417 | 6/1940 | Lawson | 66/135 |
| 2,297,440 | 9/1942 | Szues | 66/85 A |
| 2,974,505 | 3/1961 | Levin | 66/135 X |
| 3,530,688 | 9/1970 | Lombardi | 66/135 |

FOREIGN PATENTS OR APPLICATIONS

| | | | |
|---|---|---|---|
| 450,156 | 7/1936 | United Kingdom | 66/135 |

*Primary Examiner*—Mervin Stein
*Assistant Examiner*—A. M. Falik
*Attorney, Agent, or Firm*—Holman & Stern

[57] ABSTRACT

A pattern forming device in a knitting machine comprising a framework, a needle cylinder journaled in said framework and having a plurality of vertical slots in its periphery, knitting needles slidably received in said slots for vertical movement, a rotary cylinder journalled in said framework above said needle cylinder, a pattern yarn guide cylinder secured to said rotary cylinder for rotation therewith and having a plurality of vertical slots in its periphery, pattern yarn guide pieces received in said slots in the guide cylinder for vertical movement and having notches, a cam member secured to said framework and received in said notches, said cam member having rest and yarn feed cams arranged in its periphery said guide pieces having slots at the lower ends, a twisted piece loosely received in the slot of each pattern yarn guide piece and having a threaded rod integrally formed therewith and a pattern yarn guide arm connected to the lower end of said threaded rod and having a pattern yarn hole for threading a pattern yarn therethrough.

1 Claim, 5 Drawing Figures

NEEDLE WRAPPING DEVICE

SUMMARY OF THE INVENTION

This invention relates to a pattern forming device in a knitting machine which is adapted to feed pattern yarns to selected ones of a plurality of knitting needles to thereby form a desired pattern in a ground weave being knitted. The pattern forming device is devised to positively feed a pattern yarn in a simple manner in a limited space. More particularly, according to the present invention, while a ground weave is being knitted by ground yarns, a yarn or yarns are positively fed to selected knitting needles by imparting rotation to pattern yarn guide arms by the action of a cam member having rest and yarn feed cams in combination. To put more particularly, pattern yarn guide pieces received in the slots formed in a pattern yarn guide cylinder are moved vertically by the action of the cam member and the vertical movement of the guide pieces rotates flat twisted pieces received in the slots of the guide pieces by about 180° to rotate threaded rods integrally formed with the twisted pieces and connected to the yarn guide arms thereby to rotate the guide which in turn feeds a pattern yarn or yarns to selected knitting needles.

According to the present invention, there has been provided a pattern forming device in a knitting machine comprising a framework, a needle cylinder journalled in said framework and having a plurality of circumferentially spaced vertical slots in its periphery, knitting needles slidably received in said vertical slots for vertical movement, a rotary cylinder journalled in said framework above said needle cylinder, a pattern yarn guide cylinder integrally secured to the periphery of said rotary cylinder for rotation therewith and having a plurality of circumferentially spaced vertical slots in its periphery, pattern yarn guide pieces received in said slots of the guide cylinder for vertical movement as the rotary cylinder rotates and having notches, said guide pieces having slots at the lower ends, a cam member secured to said framework and received in said notches, said cam member having rest and yarn feed cams arranged in a predetermined pattern, a twisted flat piece loosely received in the slot of each of said guide pieces for rotation and having a threaded rod integrally formed therewith and a pattern yarn guide arm connected to the lower end of said threaded rod and having a pattern yarn hole through which a pattern yarn is threaded to selected ones of said knitting needles so as to form a pattern in a ground weave being knitted.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the same in any way.

BRIEF DESCRIPTION OF THE DRAWINGS

FIGS. 4-1 and 4-2 are diagrammatic views showing the progressive pattern-forming operation of the pattern-forming device of the invention.

DESCRIPTION OF A PREFERRED EMBODIMENT OF THE INVENTION

Figure 1:
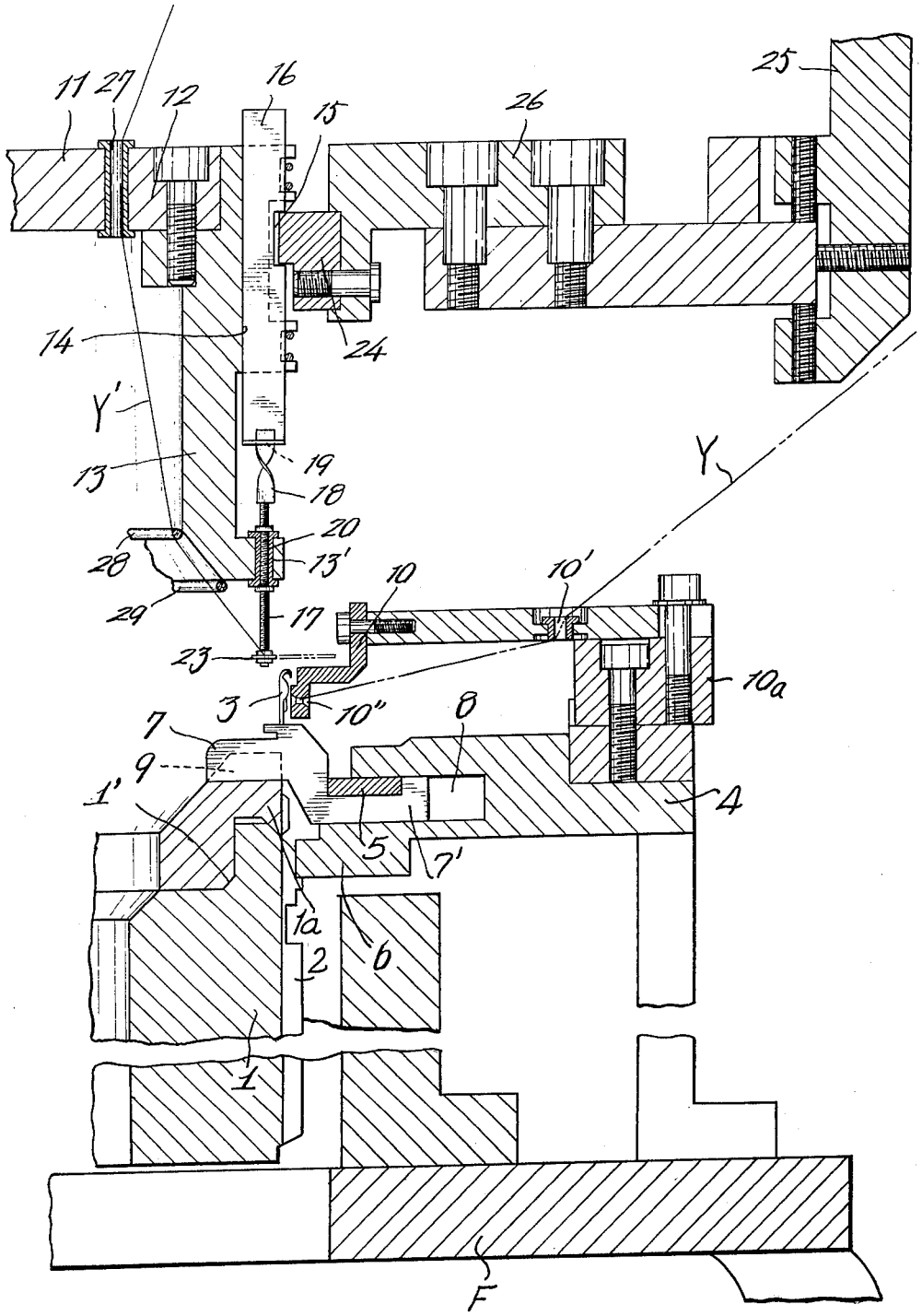
FIG. 1 is a fragmentary vertically sectional view of one preferred embodiment of pattern forming device constructed in accordance with the present invention.

The present invention will be described referring to the accompanying drawings which show one preferred embodiment of the invention. First referring to FIG. 1 in which reference numeral 1 denotes a needle cylinder having a plurality of circumferentially spaced vertical needle receiving slots 2 in its outer periphery and rotatably supported in a suitable framework F of the pattern forming device. A knitting needle 3 is slidably received in each of the vertical slots 2 for vertical movement in the manner as will be described hereinafter. The knitting needle 3 is a conventional latch needle and detailed description of the needle will be omitted herein. A plurality of cams (not shown) are provided in the framework in opposition to the needle cylinder 1 and each of the cams is adapted to engage the butt of each associated one of the knitting needles 3 so as to move the needle vertically within its associated slot 2.

An annular sinker holder 4 is provided about the upper end portion of the needle cylinder 1 and fixedly secured to a suitable support (not shown) which is in turn fixedly secured to the framework. The inner periphery of the sinker holder 4 is undercut to provide a recess 8. A sinker cam 5 is fixedly secured to the sinker holder 4 adjacent to the inner periphery of the holder with portion of the cam protruding radially and inwardly of the sinker holder.

An annular sinker support 6 is fixedly secured to the undercut of the inner periphery of the sinker holder 4 and positioned below and spaced from the sinker cam 5. The shanks 7′ of a plurality of sinkers 7 are received in the recess 8 defined between the sinker cam 5 and annular sinker support 6.

The sinker support 6 is toothed in its inner periphery for engaging in the slots 2 in the needle cylinder 1 so as to allow the sinkers 7 to rotate together with the needles 3 and needle cylinder 1 when the needle cylinder is rotated.

The top of the needle cylinder 1 is formed with an annular recess 1′ in which an annular member 1*a* is seated and the annular member is provided in its top with a plurality of circumferentially spaced slots 9 in each of which the front or inward part of each sinker 7 is received. Each of the sinkers 7 is positioned between two adjacent knitting needles 3 received in their associated slots 2. The sinkers 7 are one of the conventional sinkers employed in the conventional knitting machines and adapted to move reciprocally back and forth in the conventional manner to regulate the shape of the formed yarn loops. An annular ground yarn guide member 10 is fixedly secured to the sinker holder 4 by means of suitable fastening means such as bolts with an annular spacer 10*a* interposed therebetween and adapted to cooperate with an operation cam (not shown) for operating the knitting needles 3 in the slots 2 of the needle cylinder 1. The annular ground yarn guide member 10 is provided with a plurality of circumferentially spaced first yarn guide holes 10′ adjacent to the outer periphery of the guide member 10 and also with a plurality of circumferentially spaced second ground yarn guide holes 10'' adjacent to the inner periphery so as to feed a plurality of ground yarns Y to the latches of the needles 3 in the conventional manner. It is to be noted that one ground yarn Y is guided through each one first guide hole 10' and each one second guide hole 10''.

Positioned right above the needle cylinder 1 is a pattern yarn guide cylinder 13 fixedly secured to the flange 12 of a rotary cylinder 11 which is in turn journalled in a support arm (not shown) supported on a plurality of pillars (not shown) which are in turn suitably secured to the framework. The pattern yarn guide cylinder 13 is provided in its periphery with a plurality of circumferentially spaced vertical slots 14 in each of which a pattern yarn guide piece 16 having a notch 15 at one side edge is movably received for vertical movement.

Figure 3:
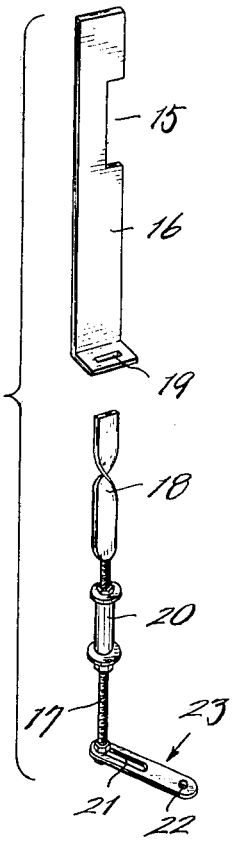
FIG. 3 is an isometrical perspective view showing one pattern yarn guide piece and its associated twisted piece and pattern yarn guide arm employed in said pattern forming device.

As more clearly shown in FIG. 3, the lower end of the pattern yarn guide piece 16 is bent at right angles with respect to the rest of the guide piece and provided with an elongated guide slot 19 in which a twisted movement transmission piece 18 in the form of a twisted flat plate is loosely received for vertical and slidable movement therethrough. The twisted piece 18 is integrally formed at its lower end with a threaded rod 17 so that when the pattern yarn guide piece 16 is moved upwardly and downwardly, the twisted piece 18 moves vertically through the slot 19 in the guide piece 16 so as to rotate the integral threaded rod 17 in one or the other direction. Threaded on the threaded rod 17 in an internally threaded sleeve 20 which is shorter than the threaded rod so as to expose the lower end portion of the rod. The sleeve 20 is supported in each of the openings formed in the outer flange 13' of the guide cylinder 13. An adjustable pattern yarn guide arm 23 is connected at one end to the extreme lower end of the exposed lower end portion of the threaded rod 17 by means of a nut and extends horizontally at right angles to the threaded rod. The adjustable arm 23 is provided with an elongated pattern yarn guide slot 21 so that the radial position of the guide arm can be adjusted with respect to the threaded rod 17 to thereby adjust the tension of the pattern yarn Y'. The adjustable arm 23 is also provided with a pattern yarn guide hole 22 through which a pattern yarn Y' is threaded. An annular cam member 24 having rest cams *a* and feed cams *b* arranged in a suitable manner in its periphery surrounds the pattern yarn guide cylinder 13 and is fitted in the notches 15 in the guide cylinder. The length of the slot 19 is larger than the width of the twisted piece 18 just enough to allow the twisted piece to move through the slot while the width of the slot is also slightly greater than the thickness of the twisted piece.

The annular cam member 24 is fixedly secured to cam support block 26 adjustably attached to a stationary hanger member 25 suspended from the above-mentioned support arm in which the rotary cylinder 11 is journalled.

Therefore, as the rotary cylinder 11 is rotated, the guide cylinder 13 integrally secured to the rotary cylinder is also rotated. The rotation of guide cylinder 13 moves the pattern yarn guide piece 16 vertically along the cam member 24 and the vertical movement of the guide piece 16 is transmitted through the twisted piece 18 and threaded rod 17 to the adjustable guide arm 23 to rotate the latter to thereby feed a stand of pattern yarn Y'. The pattern yarn Y' from a supply source (not shown) is guided through the pattern yarn hole 22 in the guide arm 23 via a yarn threading hole 27 and upper and lower yarn guide rings 28 and 29 provided in the guide cylinder 13. Reference numeral 26 denotes a cam support block which is secured to the rotary cylinder 11 and cam member 24 by means of screws.

Figure 2:
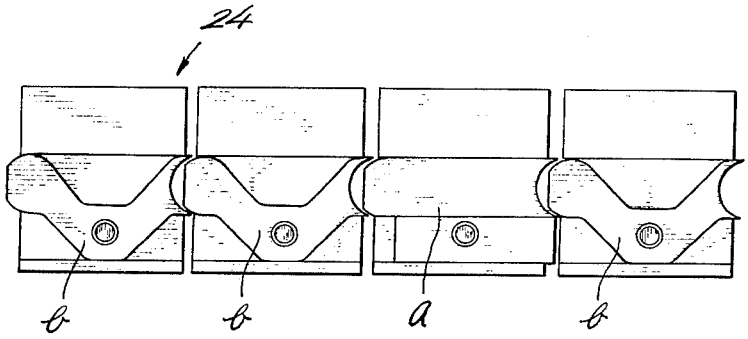
FIG. 2 is a fragmentary developed view on an enlarged scale of the cam member of said pattern forming device.
Figures 1, 4:
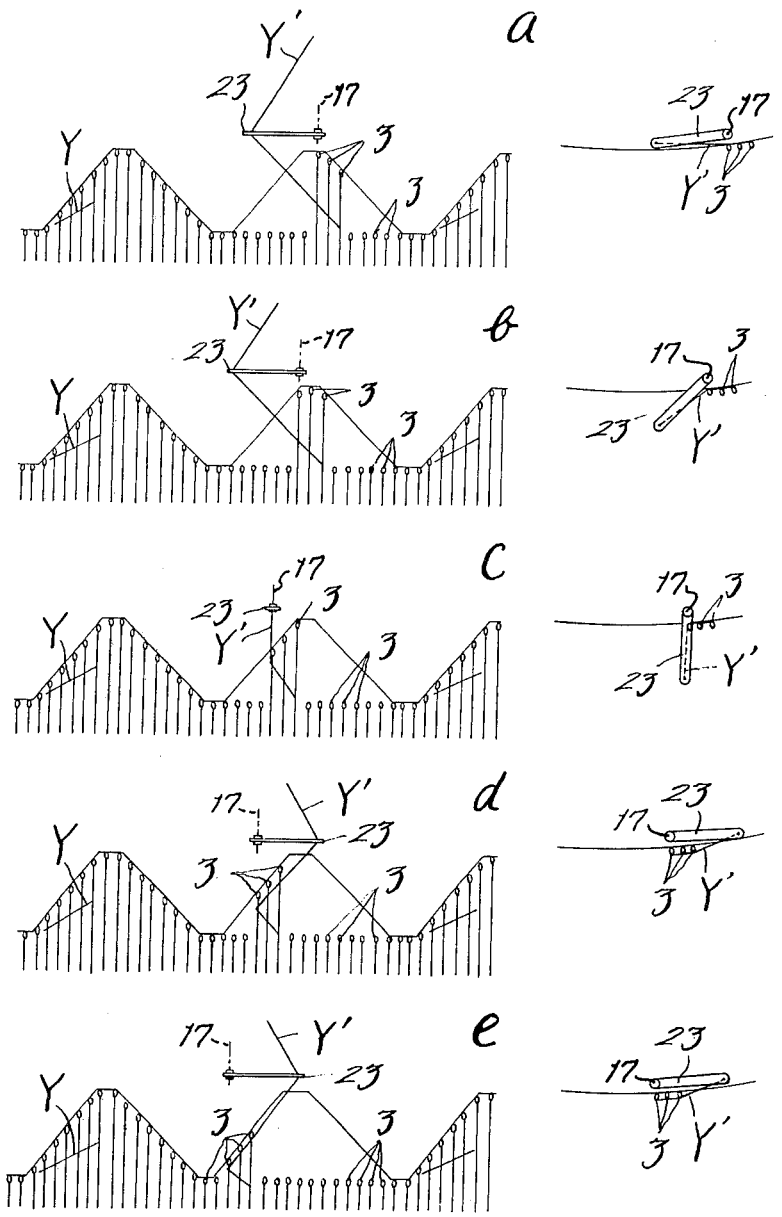
Figures 2, 4:
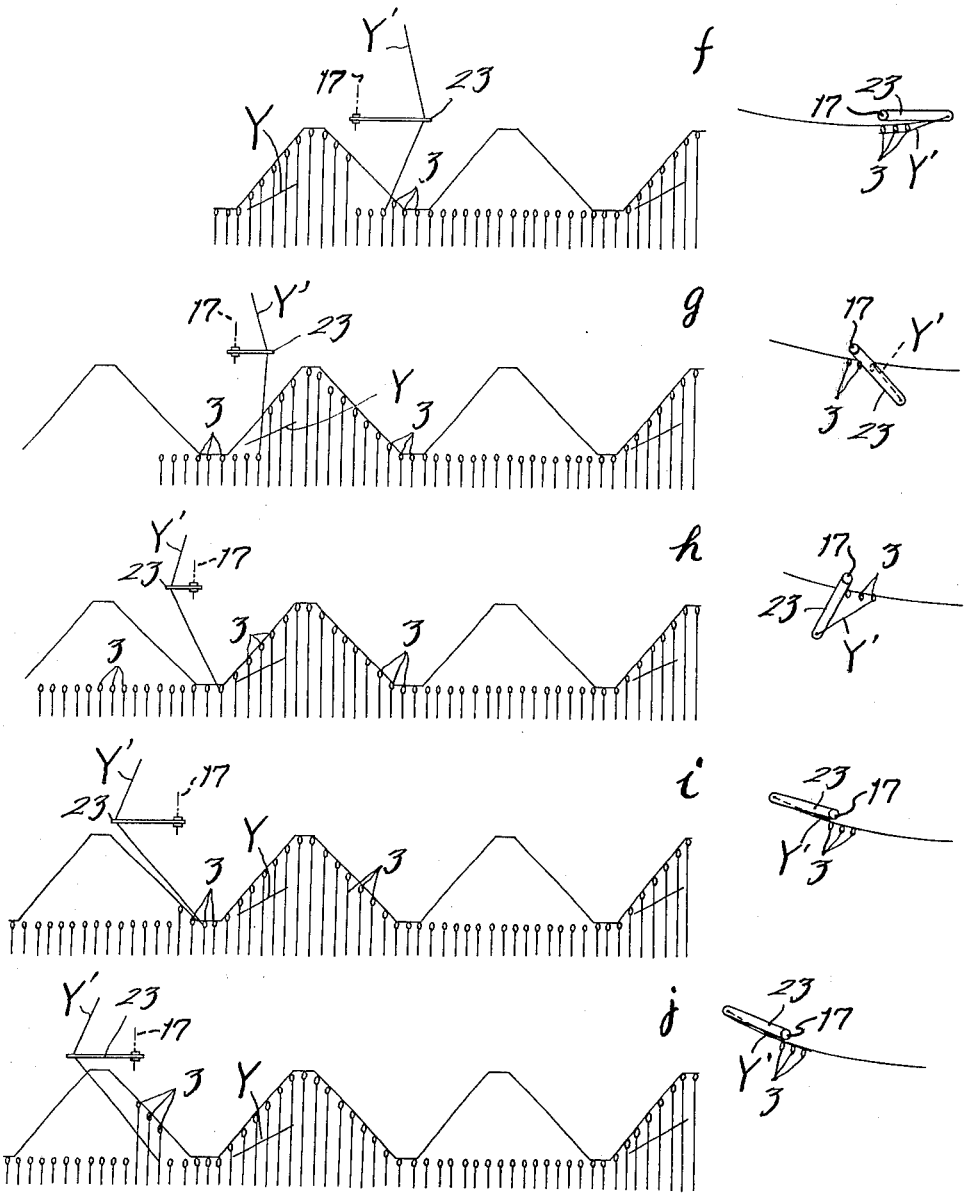

Referring now to FIG. 4-1 and FIG. 4-2 in which the changing relationship between the pattern yarn Y' and selected knitting needles 3 during a particular pattern forming operation is shown. FIGS. 4*a*, 4*b* and 4*c* show the successive stages for threading the yarn Y' through the selected knitting needles 3 when the guide arm 23 is initiated its rotation and is being rotated by the associated guide piece 16. FIG. 4*d* shows the condition in which the yarn threading operation has completed and the guide arm 23 has rotated about 180° from the position of FIG. 4*a*. FIG. 4*e* shows the guide arm 23 in its rest position after the arm has rotated about 180°, FIG. 4*f* shows the yarn guide arm 23 when the arm is waiting for the next yarn threading operation, FIG. 4*g* shows the guide arm 23 when the arm initiates its reverse direction rotation, FIG. 4*h* and 4*i* show the guide arm 23 in the successive stages during the reverse direction rotation and FIG. 4*j* shows the guide arm 23 when the arm has completed the reverse direction rotation.

With the above construction and arrangement of the parts of the pattern forming device of the invention, when the needle cylinder 1 and annular sinker support 6 rotate, the knitting needle 3 are moved upwardly and downwardly to feed ground yarns Y to the needles 3 to form a ground weave. Simultaneously, the rotary cylinder 11 is also rotated at the same rate as the needle cylinder 1 to rotate the guide pieces 16 whereby the knitting needles 3 selected in accordance with a desired pattern to be formed are raised to the position as shown in FIG. 4*a* in which the notches 15 in the pattern yarn guide pieces 16 align with the feed cams *a* which in turn raise the guide pieces 16. When the pattern yarn guide pieces 16 move upwardly, the guide pieces rotate the guide arms 23 by about one half of its one complete rotation through the associated twisted pieces 18. During the above-mentioned one half rotation in one direction, the guide arms 23 assume the successive positions as shown in FIGS. 4*b*, 4*c* and 4*d* to feed the pattern yarns Y' which are guided through the yarn holes 22 in the guide arms 23 to the latches of the selected knitting needles 3. After the completion of the yarn feed step, the guide arms 23 rest stationary by means of the rest cams *a* on the cam member 24 waiting for the next yarn feed operation (see FIG. 4*f*).

Thereafter, when the selected knitting needles 3 are raised, the guide arms 23 initiate their reverse direction rotation because the guide pieces 16 move downwardly by the action of the feed cams *b* on the cam member 24 and then assume the successive positions as shown in FIGS. 4*g*, 4*h* and 4*i* until they complete the reverse direction rotation. In the positions of the guide arms 23 as shown in FIGS. 4*g*, 4*h* and 4*i*, the pattern yarns Y' are positioned behind the selected knitting needles 3. After the knitting needles 3 have completed their upward movement with the pattern yarns Y' positioned in this position, the guide arms 23 rotate through the twisted pieces 18 as the guide pieces 16 move downwardly to feed the pattern yarns Y'. The above procedure is repeated to form successive patterns.

As clear from the foregoing description of one preferred embodiment of pattern forming device of the invention, according to the present invention, the rotary cylinder 11 is provided above the needle cylinder, the guide cylinder 13 is integrally secured to the rotary cylinder 11, the guide pieces 16 are fitted in the slots in the guide cylinder 13, and the cam member 24 having rest cams *a* and feed cams *b* arranged in accordance with a desired pattern to be formed whereby when the rotary cylinder 11 is rotated, the guide pieces 16 move vertically. And the lower ends of the guide pieces 16 have the twisted pieces 18 received in their guide holes 19, the twisted pieces 18 have their integral threaded rods 17 which in turn have the guide arms 23 connected to the lower ends of the rods whereby when the guide pieces 16 are moved vertically, the guide pieces 16 rotate the guide arms 23 through the twisted pieces 18 whereby pattern yarns Y′ which are passed through the holes 22 in the arms are fed to selected knitting needles 3 so as to form desired patterns in the ground weave being knitted. Thus, according to the present invention, pattern yarns can be positively fed to selected knitting needles in a limited space and in addition, the knitting machine is quite simple in construction and less expensive.

In the foregoing, description has been made of only one preferred embodiment, but it will readily occur to those skilled in the art that the same is illustrative in nature, but does not limit the invention in any way. The scope of the invention is only limited by the appended claim.

What is claimed is:

1. A pattern forming device in a knitting machine comprising a framework, a needle cylinder journalled in said framework and having a plurality of circumferentially spaced vertical slots in its periphery, knitting needles slidably received in said vertical slots for vertical movement, a rotary cylinder journalled in said framework above said needle cylinder, a pattern yarn guide cylinder integrally secured to the periphery of said rotary cylinder for rotation therewith and having a plurality of circumferentially spaced vertical slots in its periphery, pattern yarn guide pieces received in said slots of the guide cylinder for vertical movement as the rotary cylinder rotates and having notches, said guide pieces having slots at the lower ends, a cam member secured to said framework and received in said notches, said cam member having rest cams and yarn feed cams arranged in a predetermined pattern, a twisted piece loosely received in the slot of each of said pattern yarn guide pieces for rotation and having a threaded rod integrally formed therewith, and a pattern yarn guide arm connected to the lower end of said threaded rod and having a pattern yarn hole through which a pattern yarn is threaded to be fed to selected ones of said knitting needles so as to form a pattern in a ground weave being knitted.

* * * * *